US006831341B2

(12) United States Patent
Kan et al.

(10) Patent No.: US 6,831,341 B2
(45) Date of Patent: Dec. 14, 2004

(54) PHOTOCATHODE HAVING ALGAN LAYER WITH SPECIFIED MG CONTENT CONCENTRATION

(75) Inventors: Hirofumi Kan, Hamamatsu (JP); Minoru Niigaki, Hamamatsu (JP); Masashi Ohta, Shizuoka (JP); Yasufumi Takagi, Hamamatsu (JP); Shoichi Uchiyama, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/416,703

(22) PCT Filed: Nov. 15, 2001

(86) PCT No.: PCT/JP01/09989

§ 371 (c)(1),
(2), (4) Date: May 14, 2003

(87) PCT Pub. No.: WO02/41349

PCT Pub. Date: May 23, 2002

(65) Prior Publication Data

US 2004/0021417 A1 Feb. 5, 2004

(30) Foreign Application Priority Data

Nov. 15, 2000 (JP) ..... 2000-348376

(51) Int. Cl.[7] ..... H01J 1/34; H01J 40/06

(52) U.S. Cl. ..... 257/431; 257/10; 257/11; 313/542

(58) Field of Search ..... 257/431, 10, 11, 257/17, 21, 22, 70, 76–78, 101, 103, 201, E21.054, E31.123; 313/528, 532, 533, 534, 539, 542–544

(56) References Cited

U.S. PATENT DOCUMENTS 3,986,065 A * 10/1976 Pankove ..... 313/355

(List continued on next page.)

FOREIGN PATENT DOCUMENTS

| | | | |
|---|---|---|---|
| JP | 08096705 A | 4/1996 | ..... H01J/01/34 |
| JP | 08153462 A | 6/1996 | ..... H01J/01/34 |
| JP | 2000030604 A | 1/2000 | ..... H01J/01/34 |
| WO | WO 9703453 A2 | 1/1997 | |

OTHER PUBLICATIONS

C. Stampfl, et al., *Doping of $Al_xGa_{1-x}N$*, *Appl. Phys. Lett. 72(4)*, Jan. 26, 1998, pp. 459–461.

(List continued on next page.)

*Primary Examiner*—Minhloan Tran
*Assistant Examiner*—Thomas L Dickey
(74) *Attorney, Agent, or Firm*—Morgan, Lewis & Bockius LLP

(57) ABSTRACT

Ultraviolet light incident from the side of a surface layer 5 passes through the surface layer 5 to reach an optical absorption layer 4. Light which reaches the optical absorption layer 4 is absorbed within the optical absorption layer 4, and photoelectrons are generated within the optical absorption layer 4. Photoelectrons diffuse within the optical absorption layer 4, and reach the interface between the optical absorption layer 4 and the surface layer 5. Because the energy band is curved in the vicinity of the interface between the optical absorption layer 4 and surface layer 5, the energy of the photoelectrons is larger than the electron affinity in the surface layer 5, and so photoelectrons are easily ejected to the outside. Here, the optical absorption layer 4 is formed from an $Al_{0.3}Ga_{0.7}N$ layer with an Mg content concentration of not less than $2\times10^{19}$ $cm^{-3}$ but not more than $1\times10^{20}$ $cm^{-3}$, so that a solar-blind type semiconductor photocathode 1 with high quantum efficiency is obtained.

4 Claims, 9 Drawing Sheets

U.S. PATENT DOCUMENTS 4,616,248 A 10/1986 Khan et al. ..... 357/30
5,557,167 A 9/1996 Kim et al. ..... 313/542

OTHER PUBLICATIONS

M.A. Khan et al., *Properties and ion implantation of* $Al_zGa_{1-x}N$ *epitaxial single crystal films prepared by low pressure metalorganic chemical vapor deposition*, *App. Phys. Lett. 43 (5)*, Sep. 1, 1983, pp. 492–494.

C. Stampfl et al., Doping of AlGaN, Appl. Phys. Lett. 72(4) Jan. 26, 1998; pp. 459–461.

M.A. Khan et al., Properties and ion implantation of AlGaN epitaxial single crystals prepared by low pressure metalorganic chemical vapor deposition, Appl. Phys. Lett. 43 5 Sep. 1, 1983, pp. 492–494.

* cited by examiner

PHOTOCATHODE HAVING ALGAN LAYER WITH SPECIFIED MG CONTENT CONCENTRATION

TECHNICAL FIELD

This invention relates to a semiconductor photocathode, formed using a semiconductor as a component material, and which is excited by incident light and emits photoelectrons.

BACKGROUND ART

Conventional semiconductor photocathodes for use with ultraviolet light were formed for example from $Al_xGa_{1-x}N$. Preexisting technology related to such semiconductor photocathodes formed from $Al_xGa_{1-x}N$ is disclosed in the specification of U.S. Pat. No. 5,557,167, the specification of U.S. Pat. No. 4,616,248, and in Japanese Patent Laid-open No. 08-96705. Conventional semiconductor photocathodes formed from $Al_xGa_{1-x}N$ have a quantum efficiency sufficient to enable practical application in the ultraviolet light.

DISCLOSURE OF THE INVENTION

However, when an attempt is made to perform precise measurements, the quantum efficiency of such conventional semiconductor cathodes cannot be described as sufficient, and $Al_xGa_{1-x}N$ system semiconductor photocathodes with still higher quantum efficiencies are desired. The present invention is intended to resolve this problem, and has as an object the provision of a semiconductor photocathode with high quantum efficiency, having an optical absorption layer formed from $Al_xGa_{1-x}N$ ($0 \leqq x \leqq 1$).

Upon conducting advanced studies and research to improve the quantum efficiency of this type of semiconductor photocathode, the inventors discovered that the quantum efficiency depends heavily on the content concentration of Mg in the $Al_xGa_{1-x}N$ layer ($0 \leqq x \leqq 1$) which is the optical absorption layer.

This invention is a semiconductor photocathode which is excited by incident light and emits photoelectrons, and is characterized in that an optical absorption layer which absorbs incident light and causes the generation of photoelectrons is formed from an $Al_xGa_{1-x}N$ layer ($0 \leqq x \leqq 1$) with an Mg content concentration of $2\times10^{19}$ $cm^{-3}$ or higher and $1\times10^{20}$ $cm^{-3}$ or less. In this case, the quantum efficiency can be improved over that of the prior art.

Further, this invention is characterized in that the $Al_xGa_{1-x}N$ layer forming the optical absorption layer has a composition ratio x of $0.3 \leqq x \leqq 0.4$. Through such a configuration, a so-called solar-blind type semiconductor photocathode can be realized.

BEST MODE FOR CARRYING OUT THE INVENTION

Below, preferred embodiments of a semiconductor photocathode of this invention are explained, together with the drawings. In the following explanation, the same symbols are used for the same components, and redundant explanations are omitted.

Figure 1:
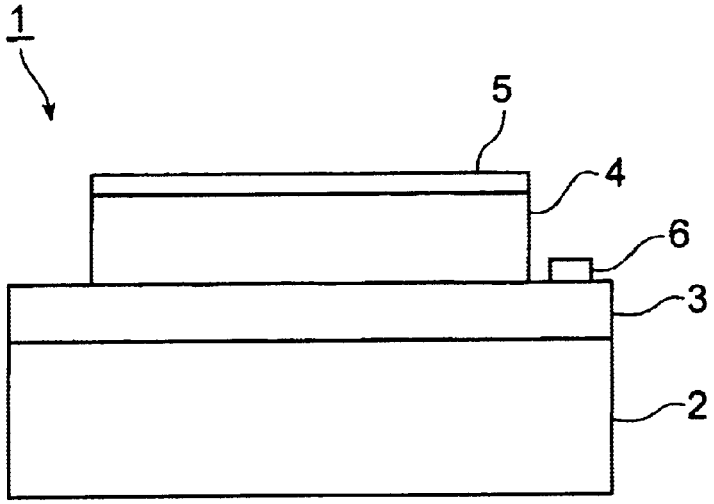
FIG. 1 is a diagram showing the structure of a semiconductor photocathode of a first embodiment.
Figure 2:
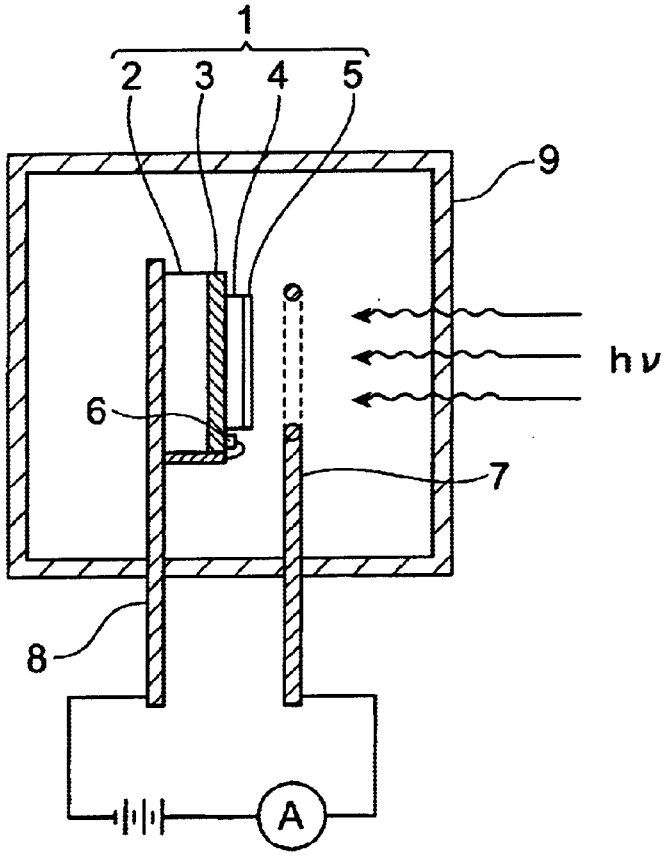
FIG. 2 is a schematic diagram showing schematically a measurement method to measure the quantum efficiency of the semiconductor photocathode of FIG. 1.
Figure 3:
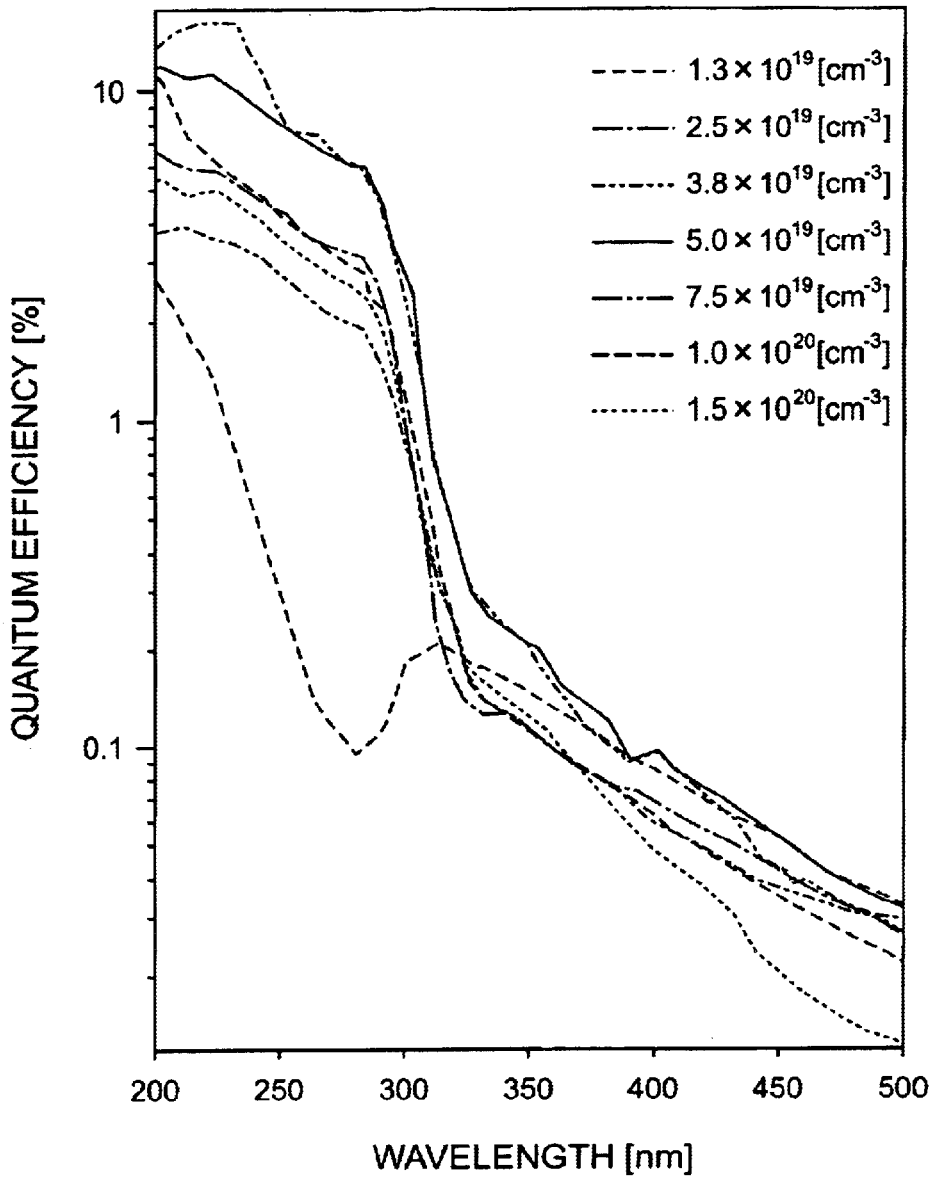
FIG. 3 is a characteristic diagram showing the wavelength dependence of the quantum efficiency of the semiconductor photocathode of FIG. 1.
Figure 4:
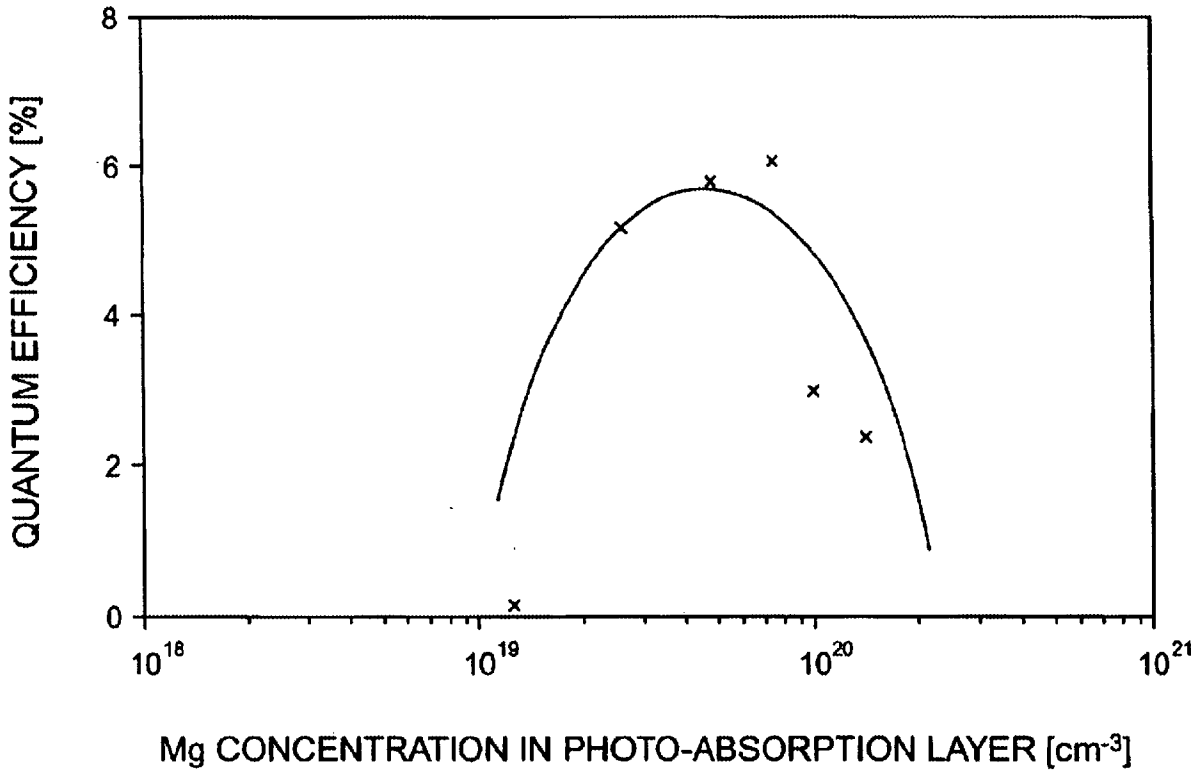
FIG. 4 is a characteristic diagram showing the Mg concentration dependence of the quantum efficiency, for light at a wavelength of 280 nm, of the semiconductor photocathode of FIG. 1.
Figure 5:
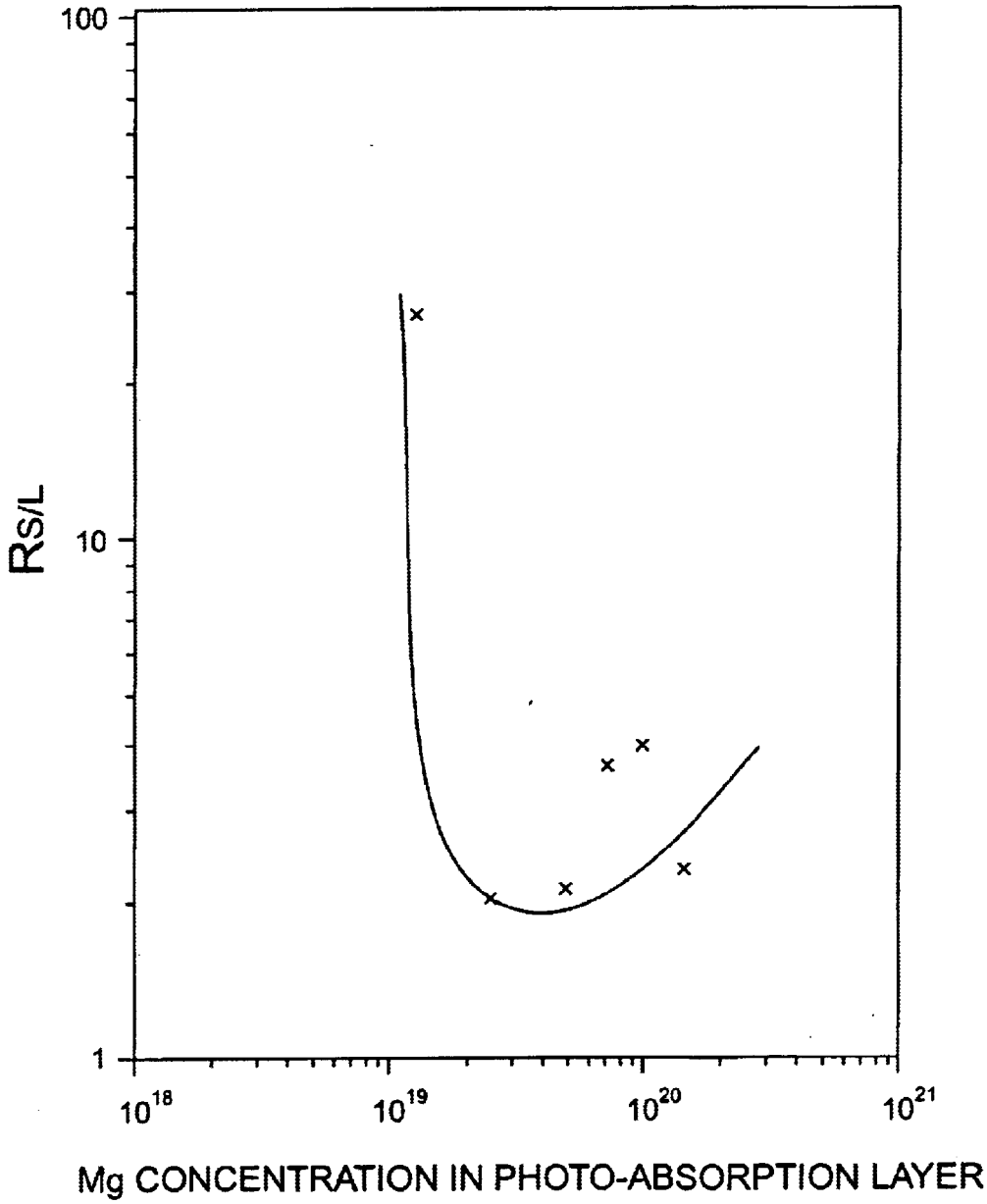
FIG. 5 is a characteristic diagram showing the Mg concentration dependence of the ratio $R_{S/L}$ of the quantum efficiency for light at a wavelength of 280 nm to the quantum efficiency for light at a wavelength of 200 nm, for the semiconductor photocathode of FIG. 1.

FIG. 1 is a drawing showing the structure of a reflection-type semiconductor photocathode of a first embodiment, employing an $Al_xGa_{1-x}N$ layer ($0 \leqq x \leqq 1$) as an optical absorption layer. FIG. 2 is a schematic diagram showing schematically a measurement method to measure the photoelectric characteristics of the semiconductor photocathode of FIG. 1. FIG. 3 is a characteristic diagram showing the wavelength dependence of the quantum efficiency of the semiconductor photocathode of FIG. 1. FIG. 4 is a characteristic diagram showing the Mg concentration dependence of the quantum efficiency, for light at a wavelength of 280 nm, of the semiconductor photocathode of FIG. 1. FIG. 5 is a characteristic diagram showing the Mg concentration dependence of the ratio $R_{S/L}$ of the quantum efficiency for light at a wavelength of 280 nm to the quantum efficiency for light at a wavelength of 200 nm, for the reflection-type semiconductor photocathode of FIG. 1.

As shown in FIG. 1, in the reflection-type semiconductor photocathode 1, a buffer layer 3 of AlN and optical absorption layer 4 of $Al_{0.3}Ga_{0.7}N$ are formed in order on a substrate 2 of sapphire; on top of the optical absorption layer 4 is formed a surface layer 5 of an oxide of Cs.

The surface layer 5 may use, either in place of or in addition to Cs, another alkali metal, such as K or Na. A portion of the surface at the interface with the optical absorption layer 4 of the buffer layer 3 is exposed, and an electrode 6 is formed in this exposed portion. The properties of $Al_xGa_{1-x}N$ are described in, for example, Applied Physics Letters, 72, 459 (1998), and in Applied Physics Letters, 43, 492 (1983).

The thickness of the buffer layer 3 is 25 nm, which in preliminary experiments yielded optimal results. Mg is added to the buffer layer 3; consequently the buffer layer 3 is p-type material with low resistivity.

The optical absorption layer 4 comprises $Al_{0.3}Ga_{0.7}N$. By varying the Al content x, the absorption edge wavelength of $Al_{0.3}Ga_{0.7}N$ can be varied between 200 nm and 365 nm. In this embodiment, the Al content of the optical absorption layer 4 was chosen to be 0.3; the reason for this is as follows.

In measurements of ultraviolet light, a so-called solar-blind type semiconductor photocathode, having high sensitivity in the wavelength range below approximately 300 nm, is desirable. Because sunlight has short-wavelength spectral components up to approximately 300 nm, when measuring ultraviolet light, the short-wavelength components of sunlight may adversely affect measurements. In order to exclude the effects of sunlight, it is preferable that the sensitivity be extremely low at wavelengths longer than approximately 300 nm, and that the sensitivity be high at wavelengths of 300 nm or below.

When the Al content x of $Al_xGa_{1-x}N$ is 0.3, the energy band gap is 4.24 eV. When converted into a wavelength, this energy band gap is equivalent to 292 nm, and so by using an Al content of 0.3 or greater, a solar-blind type semiconductor photocathode having high sensitivity at wavelengths shorter than 300 nm can be realized.

As the Al content x of the $Al_xGa_{1-x}N$ layer increases, even when an acceptor impurity is added, there is a tendency toward insulating properties. When the optical absorption layer 4 becomes insulating or takes on high resistivity, photoelectrons generated by light do not easily reach the surface layer, and as a result the quantum efficiency tends to decline. When the Al content x of $Al_xGa_{1-x}N$ exceeds 0.4, the resistivity becomes high, and so in order to obtain an optical absorption layer 4 with satisfactory electrical characteristics, it is preferable that the Al content x be below 0.4. For the above reasons, it is preferable that the Al content of the optical absorption layer be 0.3 or greater, but not greater than 0.4.

Also, Mg is added to the optical absorption layer. The Mg content concentration in the semiconductor photocathode 1 of the first embodiment is set at $5\times10^{19}$ $cm^{-3}$. The film thickness of the optical absorption layer 4 is approximately 1000 nm.

A surface layer 5 comprising a Cs oxide is formed on the optical absorption layer 4. Due to this surface layer 5, a depletion layer is formed in the vicinity of the interface between the surface layer 5 and optical absorption layer 4, so that the energy band is curved such that the apparent electron affinity in the optical absorption layer 4 becomes negative. Consequently photoelectrons which reach the interface between the surface layer 5 and the optical absorption layer 4 are easily ejected to the outside. The film thickness of the surface layer 5 is approximately that of one molecular layer.

The electrode 6 is provided on the exposed portion of the buffer layer 3 in order to maintain the potential of the semiconductor photocathode 1 at a negative level with respect to the potential of the positive electrode 7 (anode) provided opposing the surface layer 5 outside the semiconductor photocathode 1, and insofar as this object is achieved, may be an ohmic-contact electrode, or may be a Schottky-contact electrode. The electrode 6 may be formed on the entire exposed portion of the buffer layer 3, or may be formed only on a portion thereof.

Next, the action of a semiconductor photocathode 1 with the above structure is explained.

The semiconductor photocathode 1 of this embodiment is of the reflection type, so that incident light hv (light for measurement, including ultraviolet light) is incident on the semiconductor photocathode 1 from the side of the surface layer 5. The incident light hv passes through the surface layer 5 to reach the optical absorption layer 4. When the incident light hv is absorbed within the optical absorption layer 4, a photoelectron is excited within the optical absorption layer 4. This photoelectron diffuses within the optical absorption layer 4, and reaches the interface between the optical absorption layer 4 and the surface layer 5.

Near the interface between the optical absorption layer 4 and the surface layer 5, the energy band is curved such that the energy of the photoelectron is higher than the vacuum energy level in the surface layer 5, and so the photoelectron is easily ejected to the outside. Electrons ejected to the outside are collected by the anode 7 separately provided facing the surface layer 5, and are output as a signal to an external circuit. The number of photoelectrons generated in the optical absorption layer 4 increases and decreases according to the intensity of the incident light hv, so that an electrical signal corresponding to the incident light intensity is obtained.

Next, a method of manufacture of a semiconductor photocathode 1 of this embodiment is explained. The manufacturing method is divided into two processes: growth of the buffer layer 3 and optical absorption layer 4 by the MOCVD (metal-organic chemical vapor deposition) method, and formation of the surface layer 5.

The buffer layer 3 and optical absorption layer 4 were grown by the usual procedure using an MOCVD system. That is, the buffer layer 3 and optical absorption layer 4 were formed by executing, in order, four processes: (1) a substrate preparation and introduction process; (2) a substrate thermal cleaning process; (3) a process to grow the buffer layer 3; and (4) an optical absorption layer process.

The raw materials used when forming the GaAlN in process (4) were trimethyl gallium (TMG: $(CH_3)_3Ga$) as the Ga raw material, trimethyl aluminum (TMAl: $(CH_3)_3Al$) as the Al raw material, and ammonia as the N raw material. The raw material for addition of Mg was bicyclopenta-dienyl magnesium ($Cp_2Mg$: $(C_5H_5)_2Mg$).

When supplying TMG and TMAl, which are liquids at normal temperature, the so-called bubbling method was adopted, in which high-purity $H_2$ gas was caused to flow into the raw material container as a carrier gas. A similar method was employed to supply $Cp_2Mg$, which is a solid at normal temperature. Except for the Ga raw material, the raw materials used for formation of AlN in process (3) were the same as the above-described raw materials for GaAlN.

(1) Substrate preparation and introduction process: After removing oil and other components adhering to the surface of the sapphire substrate 2, the substrate was mounted in the substrate preparation chamber at a prescribed position. Then, the interior of the substrate preparation chamber was evacuated, and nitrogen gas was introduced. The substrate 2 was then transported into the reaction chamber, and was placed on a prescribed susceptor.

(2) Substrate thermal cleaning process: After placing the substrate 2 on the susceptor, hydrogen gas was introduced into the reaction chamber. The hydrogen gas flow rate was 10,000 sccm, and the pressure within the reaction chamber at this time was 133 Pa. After the atmosphere within the reaction chamber had been sufficiently displaced by hydrogen, the substrate 2 was heated to 1050° C. The substrate 2 was held at this temperature for 5 minutes, to remove oxides, impurities and similar from the surface of the substrate 2.

(3) Buffer layer growth process: After completion of the substrate thermal cleaning process, the substrate temperature was lowered to 450° C.

After the temperature of the substrate 2 was stable at 450° C., $NH_3$ and TMAl were supplied, and growth of the buffer layer 3 (AlN) was initiated. At this time, the $NH_3$ flow rate was 5000 sccm, and the flow rate of the TMAl carrier gas was 50 sccm. During growth, $Cp_2Mg$ was supplied, to add Mg to the buffer layer 3. The amount of $Cp_2Mg$ supplied was made equal to the amount supplied during growth of the optical absorption layer 4 described below.

The pressure in the reaction chamber during growth was 133 Pa. After a prescribed growth time, the supply of TMAl was halted, and growth of the buffer layer 3 was ended. This prescribed growth time is the time required for a film thickness of 50 nm, computed based on the growth rate for an AlN layer determined in preliminary experiments conducted under the same conditions as those described above.

(4) Optical absorption layer growth process: After the end of growth of the buffer layer 3, while continuing to supply $NH_3$, the temperature of the substrate 2 was raised to 1075° C. After the temperature stabilized, TMGa and TMAL were supplied, and growth of the optical absorption layer 4 was begun. The Al content x is determined by the ratio of the amounts of TMGa and TMAl supplied; when the TMGa carrier gas flow rate was 5 sccm and the TMAl carrier gas flow rate was 10 sccm, $Al_{0.3}Ga_{0.7}N$ was obtained.

During growth, $Cp_2Mg$ was supplied at a carrier gas flow rate of 10 sccm, to add Mg to the optical absorption layer 4. At this flow rate, the concentration of the Mg added to the optical absorption layer 4 was $5\times10^{19}$ $cm^{-3}$.

When the film thickness of the optical absorption layer 4 reached 100 nm, the supply of TMAl, TMGa and $Cp_2Mg$ was halted, and growth of the optical absorption layer 4 was ended.

Thereafter, the temperature of the substrate 2 was lowered to 850° C. While the temperature was being lowered to 850° C., the supply of $NH_3$ was continued, in order to prevent desorption of hydrogen atoms from the newly grown optical absorption layer 4. Upon reaching 850° C., the supply of $NH_3$ was halted, and the supply of nitrogen gas was initiated. The amount of nitrogen gas supplied was 15 SLM. Then, the substrate 2 was left at 850° C. for 20 minutes in the nitrogen gas atmosphere. By this means, the resistivity of the buffer layer 3 and optical absorption layer 4 was lowered.

After lowering the temperature to room temperature, the substrate 2 was transported from the reaction chamber to the substrate preparation chamber. After evacuating the substrate preparation chamber, nitrogen was introduced and the pressure was returned to atmospheric pressure. By this means, the hydrogen remaining in the substrate preparation chamber could be replaced, so that after this operation was completed, the substrate 2 was removed.

The growth by the MOCVD method of the buffer layer 3 and optical absorption layer 4 as described above was performed automatically by means of a prescribed program.

Next, the method of formation of the surface layer 5 is explained. After removal from the MOCVD system, the substrate 2 was placed on a susceptor in a vacuum device. After being placed on the susceptor, the substrate 2 was heated to 450° C. and held at this temperature for 10 minutes, to clean the surface. Then, the substrate 2 was held at a prescribed temperature, and after stabilization at this temperature, Cs and oxygen were supplied to the substrate 2 in alternation to form a $CsO_2$ layer. Here a chromate was used as the Cs raw material.

Next, the photoelectric properties of the semiconductor photocathode 1 fabricated as described above are explained.

FIG. 2 is a schematic diagram showing schematically a measurement method to measure the quantum efficiency of the semiconductor photocathode 11. As shown in the figure, the semiconductor photocathode 1 is fabricated from materials which transmit incident light hv (light for measurement), and is held by a stem serving also as an electrode terminal within the container 9, the interior of which is depressurized. This electrode terminal and stem 8 is connected to the electrode 6 by gold wire. A direct-current voltage (300 V) is applied across the electrode 6 (cathode) and the anode 7 which is a rectangular frame provided opposing the surface of the surface layer 5, such that the anode 7 is at a positive potential.

In this state, light hv is made incident on the semiconductor cathode 1 from the side of the surface layer 5, and the quantum efficiency is calculated from the power of the incident light, the current flowing in the external circuit during irradiation, and the applied voltage.

FIG. 3 is a characteristic diagram showing the wavelength dependence of the quantum efficiency of the semiconductor photocathode 1. In measurements, ultraviolet light emitted from a heavy hydrogen lamp or a halogen lamp (including light in the visible wavelength range) passed through a spectroscope and was analyzed, and irradiated the semiconductor photocathode 1; the quantum efficiency was then determined for different spectral wavelengths. In FIG. 3, for purposes of comparison, results are shown for a plurality of semiconductor photocathodes 1 having the same structure as that of the semiconductor photocathode of FIG. 1, but with different Mg concentrations in the optical absorption layer 4. The method of manufacture of each of the semiconductor photocathodes 1 is, except for the amount of $Cp_2Mg$ supplied, the same as the method of manufacture described above.

As is clear from FIG. 3, in the wavelength range of approximately 300 nm or below, the quantum efficiency of the semiconductor photocathode 1 of the first embodiment (with an Mg concentration in the optical absorption layer 4 of $5\times10^{19}$ $cm^{-3}$) is approximately 2.7%, and satisfactory solar-blind properties are exhibited. Further, in the wavelength range from 200 nm to 280 nm, the quantum efficiency is particularly high, at approximately 5% or higher.

As is clear from FIG. 3, the quantum efficiency depends on the Mg concentration of the optical absorption layer 4. Hence the Mg concentration dependence of the quantum efficiency was investigated.

FIG. 4 is a characteristic diagram showing the Mg concentration dependence of the quantum efficiency, for light hv at a wavelength of 280 nm, of a reflection-type semiconductor photocathode 1. Measured values of the quantum efficiency for different Mg concentrations are shown in Table 1. The Mg concentration of the optical absorption layer 4 in the semiconductor photocathode 1 was measured by secondary ion mass spectroscopy (SIMS). For reference, the Mg concentrations in the optical absorption layer 4 as determined by SIMS are shown together with the amount of $Cp_2Mg$ supplied (and flow rate of the carrier gas ($H_2$)) in Table 2.

TABLE 1

| Mg concentration in optical absorption layer, $cm^{-3}$ | Quantum efficiency for light at wavelength 280 nm, percent (reflection type) |
|---|---|
| $1.25 \times 10^{19}$ | 0.0971 |
| $2.5 \times 10^{19}$ | 5.01 |
| $5 \times 10^{19}$ | 5.84 |

TABLE 1-continued

| Mg concentration in optical absorption layer, $cm^{-3}$ | Quantum efficiency for light at wavelength 280 nm, percent (reflection type) |
|---|---|
| $7.5 \times 10^{19}$ | 6.09 |
| $1 \times 10^{20}$ | 2.89 |
| $1.5 \times 10^{20}$ | 2.37 |

TABLE 2

| $H_2$ flow rate, sccm | Amount of $Cp_2Mg$ supplied, $\mu$mol/min | Mg concentration in optical absorption layer, $cm^{-3}$ |
|---|---|---|
| 2.50 | 0.01 | $1.25 \times 10^{19}$ |
| 5.00 | 0.02 | $2.5 \times 10^{19}$ |
| 7.50 | 0.03 | $3.75 \times 10^{19}$ |
| 10.00 | 0.04 | $5 \times 10^{19}$ |
| 15.00 | 0.06 | $7.5 \times 10^{19}$ |
| 20.00 | 0.08 | $1 \times 10^{20}$ |
| 30.00 | 0.12 | $1.5 \times 10^{20}$ |

As is clear from FIG. 4, as the Mg concentration is increased the quantum efficiency rises, reaching a maximum at a concentration of approximately $5\times10^{19}$ $cm^{-3}$. If the Mg concentration is increased beyond this value, the quantum efficiency declines. The inventors reason that the Mg concentration range in which a quantum efficiency of 3.5% or above is exhibited, that is, $2\times10^{19}$ $cm^{-3}$ or above and $1\times10^{20}$ $cm^{-3}$ or below, is preferred.

A reason for regarding the above range as preferred may also be derived from the following results.

FIG. 5 plots the ratio $R_{S/L}$ of the quantum efficiency for light at a wavelength of 200 nm to the quantum efficiency for light at wavelength 280 nm against the Mg concentration. As is clear from FIG. 5, $R_{S/L}$ declines rapidly as the Mg concentration increases from $1.3\times10^{19}$ $cm^3$, and tends to increase again when $5\times10^{19}$ $cm^{-3}$ is passed. $R_{S/L}$ is heavily dependent on the crystallinity of the optical absorption layer 4.

That is, when the crystallinity of the optical absorption layer 4 is poor and there are numerous defects, photoelectrons are trapped by defects, so that the number of photoelectrons generated by long-wavelength light decreases markedly. Hence $R_{S/L}$ serves as an indicator of the crystallinity of the optical absorption layer 4, and the closer this value is to 1, the better the crystallinity.

As is seen from FIG. 4, although there is scattering in the measurement results, $R_{S/L}$ takes on the low value of approximately 2.1 or less in the Mg concentration range of $2\times10^{19}$ $cm^{-3}$ or greater and $1\times10^{20}$ $cm^{-3}$ or less; this result indicates that the crystallinity of the optical absorption layer 4 is satisfactory for practical purposes. Hence from the stand point of the crystallinity of the optical absorption layer 4 also, an Mg concentration of $2\times10^{19}$ $cm^{-3}$ or higher and $1\times10^{20}$ $cm^{-3}$ or lower is preferable.

From the results of FIG. 4 and FIG. 5 above, if the Mg concentration in the optical absorption layer 4 is greater than or equal to $2\times10^{19}$ $cm^{-3}$ and less than or equal to $1\times10^{20}$ $cm^{-3}$ then a semiconductor photocathode formed from $Al_xGa_{1-x}N$ ($0\leqq x\leqq 1$) is obtained having a markedly high quantum efficiency compared with a semiconductor photocathode of the prior art. It was also found that, in order to further improve the quantum efficiency and crystallinity of a semiconductor photocathode in which the Mg concentration of the optical absorption layer 4 is within the above range, it is preferable that the Mg concentration be $3\times10^{19}$ $cm^{-3}$ or greater and $8\times10^{19}$ $cm^{-3}$ or less. The optical absorption layer 4 can also be of GaN or of AlN. Also, In can be added, so that (the optical absorption layer) is of InAlGaN.

As explained above, in the semiconductor photocathode 1 of the first embodiment, the Mg concentration in the $Al_xGa_{1-x}N$ which forms the optical absorption layer 4 is in the range from $2\times10^{19}$ $cm^{-3}$ to $1\times10^{20}$ $cm^{-3}$, so that a high quantum efficiency is obtained.

Figure 6:
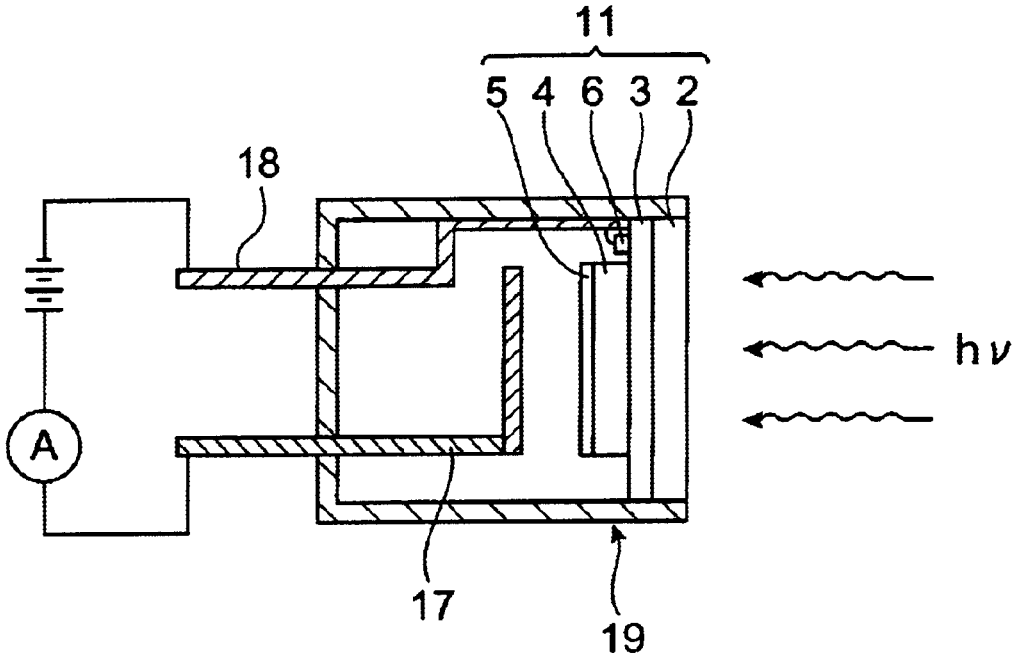
FIG. 6 is a schematic diagram showing schematically a measurement method to measure the quantum efficiency of a semiconductor photocathode of a second embodiment.

Next, a second embodiment of a semiconductor photocathode of this invention is explained. The semiconductor photocathode 11 (see FIG. 6) of the second embodiment is the so-called transmission type, in which the direction of light incidence and the direction of photoelectron emission are the same. Except for the fact that the film thickness of the optical absorption layer 4 is different, the transmission-type semiconductor photocathode 11 has the same configuration (comprising components 2, 3, 4, 5, 6) as the semiconductor photocathode 1 of the first embodiment. Hence an explanation of similarities is omitted, and only points of difference are described.

In the semiconductor photocathode 11 of the second embodiment, the film thickness of the optical absorption layer 4 is determined based on the following reason. The semiconductor photocathode 11 of the second embodiment is of the transmission type, so that after the incident light hv (light for measurement) passes through the substrate 2 and buffer layer 3, it is absorbed by the optical absorption layer 4. Photoelectrons are generated due to the absorbed light, but these photoelectrons are created in numerous quantities within the optical absorption layer 4 on the side of the interface with the buffer layer 3.

Photoelectrons generated on the side of the interface with the buffer layer 3 diffuse within the optical absorption layer 4 toward the surface layer 5. When the film thickness of the optical absorption layer 4 is sufficiently thick compared with the diffusion length of the photoelectrons, the photoelectrons undergo recombination during diffusion, or are trapped by lattice defects or similar, and cannot be removed to the outside. Consequently it is preferable that the film thickness of the optical absorption layer 4 be substantially the same as the photoelectron diffusion length.

In consideration of this, the film thickness of the optical absorption layer 4 was made less than the diffusion length of photoelectrons within the optical absorption layer 4. The diffusion length in $Al_xGa_{1-x}N$ when the Al content x is 0.3 is 50 nm, and is 100 nm when the Al content x is 0; hence the film thickness of the optical absorption layer 4 was set to 100 nm or less.

The semiconductor photocathode 11 in the above second embodiment is manufactured by a method similar to that for the semiconductor photocathode 1 of the first embodiment. The film thickness of the optical absorption layer 4 is adjusted by changing the growth time during growth by the MOCVD method.

Next, the action of a transmission-type semiconductor photocathode 11 is explained.

Incident light hv (light for measurement) is incident on the rear surface of the sapphire substrate 2 (the surface on the opposite side of the interface with the buffer layer 3). The incident light hv passes in order through the sapphire substrate 2 and buffer layer 3, to reach the optical absorption layer 4. When the light is absorbed within the optical absorption layer 4, photoelectrons are generated. These photoelectrons diffuse within the optical absorption layer 4, and reach the interface between the optical absorption layer 4 and the surface layer 5. Near the interface between the optical absorption layer 4 and surface layer 5, the energy band is curved, so that the energy of the photoelectrons exceeds the vacuum energy level in the surface layer 5.

Consequently, photoelectrons which have reached the surface layer 5 are easily ejected to the outside. Electrons which have been ejected to the outside are collected by the anode 7, provided separately so as to oppose the surface layer 5, and are output as a signal to an external circuit. The number of photoelectrons generated in the optical absorption layer 4 is increased or reduced according to the intensity of the incident light hv, and so an electrical signal corresponding to the intensity of the incident light hv is obtained.

Next, the photoelectric properties of the transmission-type semiconductor photocathode 11 are explained. The measurement method shown in FIG. 6 was used to measure the photoelectric properties of the semiconductor photocathode 11. That is, the semiconductor photocathode 11 is fixed in the aperture portion of a container 19 such that the rear surface of the substrate 2 (the surface on the side opposite the interface with the buffer layer 3) becomes the light incidence window. The container 19 is sealed in a state in which the interior was depressurized. The electrode terminal 18 and electrode 6 are connected using gold wire.

A direct-current voltage (300 V) is applied across the electrode terminal 18 and the anode 17 provided opposing the surface layer 5. In this state, the semiconductor photocathode 11 was irradiated with light from the side of the substrate 2, and the quantum efficiency was calculated from the irradiated optical power, the current flowing in the external circuit during irradiation, and the applied voltage.

Figure 7:
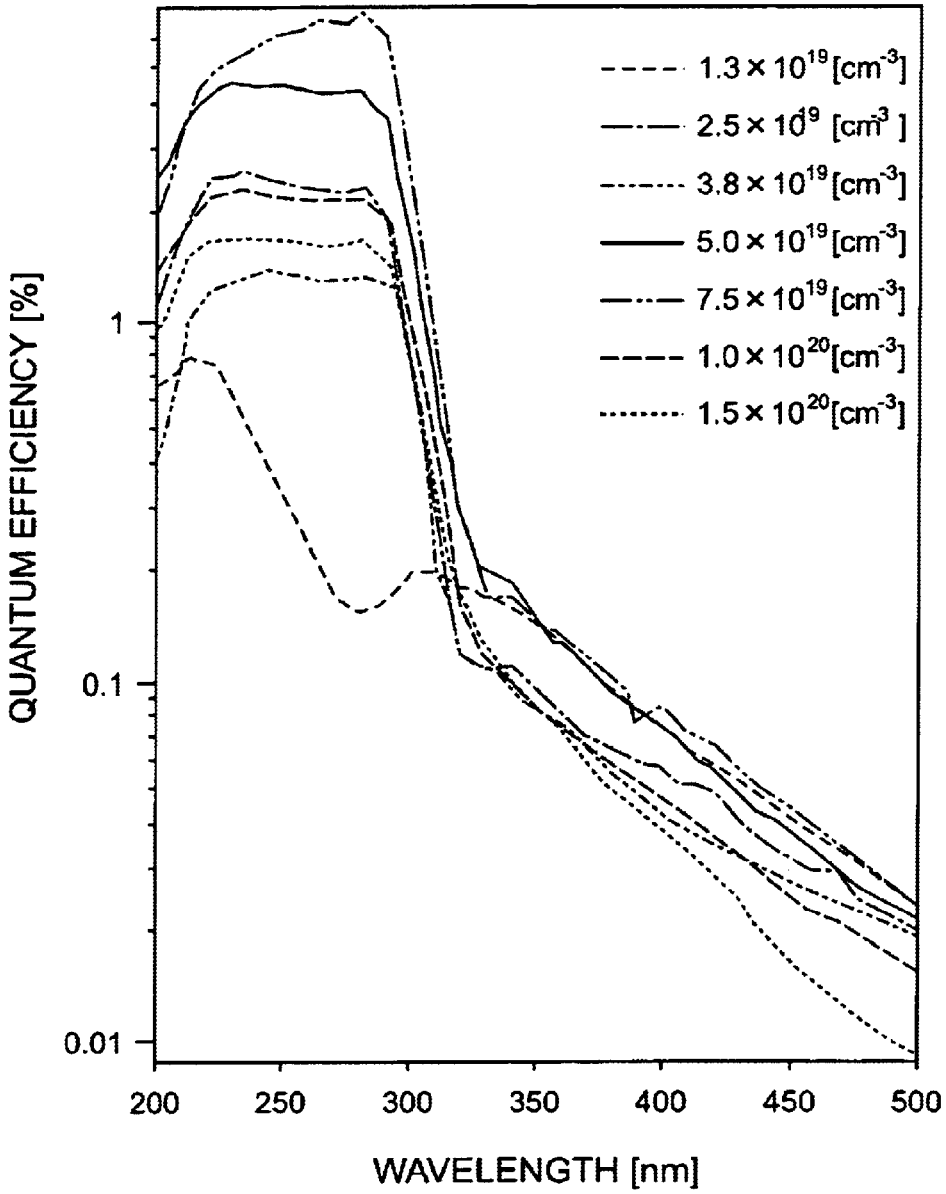
FIG. 7 is a characteristic diagram showing the wavelength dependence of the quantum efficiency of the semiconductor photocathode of the second embodiment.

FIG. 7 is a characteristic diagram showing the wavelength dependence of the quantum efficiency of the transmission-type semiconductor photocathode 11 of the second embodiment. FIG. 7 compares the wavelength dependences of a plurality of semiconductor photocathodes, with the same configuration but with different Mg concentrations in the optical absorption layer 4. Except for the different amounts of $Cp_2Mg$ supplied, the plurality of semiconductor photocathodes 11 were fabricated by the same method described above.

As is clear from FIG. 7, at wavelengths of approximately 300 nm or below the semiconductor photocathode 11 of the second embodiment (with an Mg concentration in the optical absorption layer 4 of $5\times10^{19}$ $cm^{-3}$) exhibits a quantum efficiency of 2 to 4%, and exhibits satisfactory solar-blind characteristics. For light in the 200 to 280 nm wavelength range, the quantum efficiency was particularly high at approximately 4.1%.

From FIG. 7, it is seen that the quantum efficiency depends on the Mg concentration of the optical absorption layer 4. Hence the Mg concentration dependence of the quantum efficiency was studied.

Figure 8:
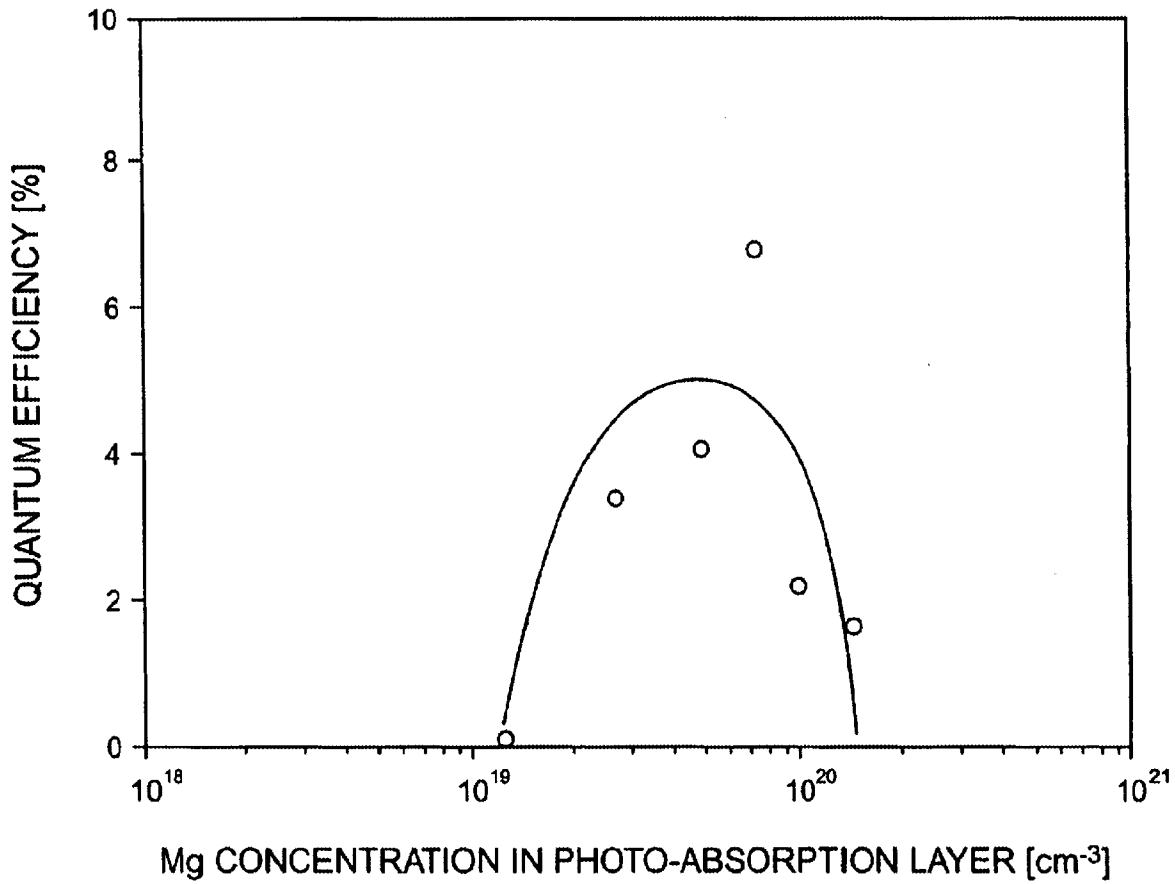
FIG. 8 is a characteristic diagram showing the Mg concentration dependence of the quantum efficiency for light at a wavelength of 280 nm, for these semiconductor photocathode of the second embodiment.

FIG. 8 shows the Mg concentration dependence of the quantum efficiency for light at a wavelength of 280 nm, for the semiconductor photocathode of the second embodiment. Measured values for the quantum efficiency for different Mg concentrations appear in Table 3.

TABLE 3

| Mg Concentration in the optical absorption layer, $cm^{-3}$ | Quantum efficiency for light at wavelength 280 nm, percent (transmission type) |
|---|---|
| $1.25\times10^{19}$ | 0.151 |
| $2.5\times10^{19}$ | 3.74 |
| $5\times10^{19}$ | 4.21 |
| $7.5\times10^{19}$ | 6.82 |
| $1\times10^{20}$ | 2.15 |
| $1.5\times10^{20}$ | 1.65 |

As is clear from FIG. 8, the quantum efficiency increases with increasing Mg concentration, reaching a maximum when the concentration is approximately $5\times10^{19}$ $cm^{-3}$ and then decreasing as the Mg concentration is further increased. Particularly when the Mg concentration is in the range from $2\times10^{19}$ $cm^{-3}$ to $1\times10^{20}$ $cm^{-3}$, a high quantum efficiency of approximately 3.5% is obtained.

As explained above, in the case of the transmission-type semiconductor photocathode 11 of the second embodiment also, the Mg concentration comprised by the $Al_xGa_{1-x}N$ forming the optical absorption layer 4 is in the range from $2\times10^{19}$ $cm^{-3}$ to $1\times10^{20}$ $cm^{-3}$, so that a high quantum efficiency is obtained.

This invention is not limited to the above embodiments, and various modifications are possible. The film thickness of the buffer layer 3 was set to 50 nm, but the film thickness is not thereby limited, and may be, for example, from 10 nm to 200 nm. A particularly preferable film thickness for the buffer layer 3 is as follows. The buffer layer 3 also serves as a window layer, and so a flat layer is desirable; to this end, a thickness of at least 15 nm is preferable. If the thickness is made greater than necessary, the growth time is increased, and as a consequence costs rise; hence a thickness of approximately 100 nm or less is preferable.

In the case of the transmission-type semiconductor photocathode 11, in order to suppress insofar as possible the absorption of light in the buffer layer 3, it is preferable that the buffer layer 3 be thin; specifically, a thickness between approximately 15 nm and approximately 500 nm is desirable.

In the above embodiment, the buffer layer 3 was formed of AlN, but formation from $Al_xGa_{1-x}N$ is also possible. When applying an $Al_xGa_{1-x}N$ buffer layer to a reflection-type semiconductor photocathode 11, the Al content x of the $Al_xGa_{1-x}N$ buffer layer may be an arbitrary value equal to or greater than 0 and equal to or less than 1. In a reflection-type semiconductor photocathode 11, light is incident from the side of the surface layer 5, and so there is no danger of light absorption by the buffer layer 3. In particular, the Al content x of the buffer layer 3 may be made the same as the Al content of the optical absorption layer 4.

Figure 9:
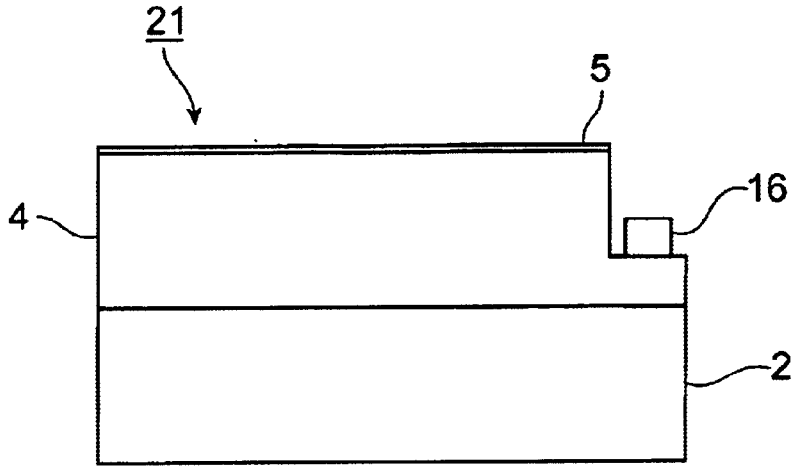
FIG. 9 is a schematic diagram showing the configuration of a semiconductor photocathode in which an optical absorption layer is formed directly on substrate.

FIG. 9 is a schematic diagram showing a semiconductor photocathode 21 in which the Al content x of the buffer layer 3 is the same as the Al content of the optical absorption layer 4. As is seen from this drawing, the semiconductor photocathode 21 has the apparent configuration of an optical absorption layer 4 formed directly on the substrate 2, and there is no clear distinction between the buffer layer 3 and the optical absorption layer 4. In this case, it is preferable that the film thickness of the optical absorption layer 4 be between 25 nm and 200 nm, and more preferable still that the thickness be from 50 nm to 100 nm. In the case of such a configuration, a portion of the optical absorption layer 4 is made thin by etching or other means, and an electrode 16 is formed on this thin portion.

When an $Al_xGa_{1-x}N$ buffer layer is employed in a transmission-type semiconductor photocathode 11, it is preferable that the Al content x be higher than the Al content x of the optical absorption layer 4. This is in order that light incident from the rear side of the substrate 2 can reach the optical absorption layer 4 without being absorbed by the buffer layer 3.

Further, in the case of a transmission-type semiconductor photocathode 11, the Al content x of the buffer layer 3 formed from $Al_xGa_{1-x}N$ can be gradually changed in the direction perpendicular to the substrate 2. In this case, it is more preferable still that (the Al content x of the buffer layer) be changed gradually such that x=1 at the interface with the substrate 2, and at the interface with the optical absorption layer 4, x is the same as the Al content x of the $Al_xGa_{1-x}N$ forming the optical absorption layer 4. The reason for this is as follows.

In a transmission-type semiconductor photocathode 11, the incident light hv (light for measurement) is incident from the side of the substrate 2. In the case of this configuration, the incident light must reach the optical absorption layer 4 without being absorbed in the buffer layer 3. To this end, it is preferable that the energy band gap of the buffer layer 3 be made larger. The energy band gap of $Al_xGa_{1-x}N$ is maximum (6.2 eV) when the Al content x is 1. Hence in order to prevent absorption of the incident light hv by the buffer layer 3, an Al content x for the buffer layer 3 of 1 is suitable.

However, when the Al content x is 1 (that is, when the buffer layer 3 is AlN), the difference between the lattice constant of the optical absorption layer 4 ($Al_{0.3}Ga_{0.7}N$) formed on top of the buffer layer 3 and the lattice constant of AlN is large, at approximately 1.77%. When the optical absorption layer 4 is formed on top of such a buffer layer 3, there is concern that numerous lattice defects will result. If there are numerous lattice defects in the optical absorption layer 4, photoelectrons generated due to incident light hv are easily captured by lattice defects, and so a situation occurs in which photoelectrons cannot be efficiently removed.

In order to avoid such a situation, it is desirable that the difference between the lattice constants of the buffer layer 3 and the optical absorption layer 4 be reduced, and that the occurrence of lattice defects in the optical absorption layer 4 be suppressed. To this end, the Al content of the buffer layer 3 may be set to 1 at the interface with the substrate 2, and gradually changed such that at the interface with the optical absorption layer 4 the value is the same as the Al content x of the $Al_xGa_{1-x}N$ forming the optical absorption layer 4.

In addition to preventing the absorption of light incident from the side of the substrate 2 as described above, as a method of reducing the lattice mismatch with the optical absorption layer 4, a buffer layer having a superlattice structure may be used.

Figure 10:
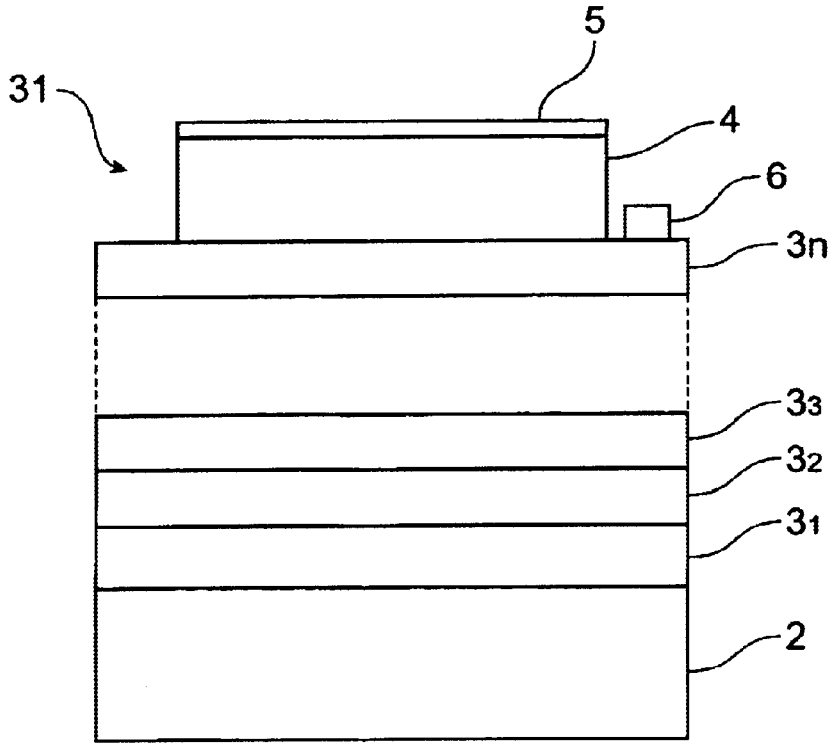
FIG. 10 is a schematic diagram showing one example of a semiconductor photocathode comprising a buffer layer having a superlattice structure; and, FIG. 11 is a schematic diagram showing the configuration of an image intensifier to which is applied a semiconductor photocathode of this invention.

FIG. 10 is a schematic diagram showing one example of a semiconductor photocathode comprising a buffer layer having a superlattice structure (superlattice buffer layer) This superlattice buffer comprises $Al_xGa_{1-x}N$ thin film layers consisting of n layers, which are, in order from the side of the interface with the substrate 2, a first layer $\mathbf{3}_1$, second layer $\mathbf{3}_2$, third layer $\mathbf{3}_3$, . . . , and nth layer $\mathbf{3}_n$. The film thickness of each thin film layer may be determined appropriately from the total film thickness and the number of layers, and may be, for example, from 10 to 500 nm.

Between the Al content $x_1$ of the first layer $\mathbf{3}_1$, the Al content $x_2$ second layer 32, the Al content $x_3$ of the third layer $\mathbf{3}_3$, . . . , and the Al content $x_n$ of the nth layer $\mathbf{3}_n$, there is the relation $X_1>X_2>X_3>. . . >X_n$ (where $\mathbf{0} \leqq X_1, X_2, X_3, . . . x_n n \leqq 1$). Further, the Al content $x_n$ of the nth layer, on the surface of which is formed the optical absorption layer 4, is equal to the Al content x of the optical absorption layer 4. By this means, the Al content x of the superlattice buffer layer is large on the side of the substrate interface, and equal to the Al content x of the optical absorption layer on the side of the optical absorption layer.

When such a superlattice buffer layer is grown using an MOCVD system, the amount of TMAl supplied may be increased in a step like manner as a function of the growth time.

Further, the film thicknesses and growth temperatures of the individual extremely thin layers comprised by the superlattice buffer layer may be made the same for each layer, or may be made different for each layer.

Further, growth temperatures may be changed in alternation for each layer, for instance using a low temperature (for example 450° C.) for the first layer 31, a high temperature (for example 1075° C.) for the second layer 32, a low temperature for the third layer 33, and so on. Conversely, a high temperature may be used for the first layer 31, a low temperature for the second layer 32, a high temperature for the third layer 33, and so on.

Also, a structure may be employed in which the above-described superlattice buffer layer is enclosed between the buffer layer 3 of the above-described embodiments and the optical absorption layer 4. Or, a buffer layer 3 and superlattice buffer layer may be formed in order on the substrate 2, and on top of this superlattice buffer layer, a buffer layer 3 and optical absorption layer 4 may then be formed in order.

In these ways, by forming a multilayer film on the substrate, with the film thickness and growth temperature of each layer changed, lattice relaxation can be promoted, and so there is the advantage that the crystallinity of an optical absorption layer 4 formed on top of such a multilayer film will be improved.

Focusing on the improvement in crystallinity of the optical absorption layer 4 resulting from a buffer layer which employs a superlattice buffer layer or an Al content x which changes in the direction perpendicular to the substrate as described above, such a buffer layer may also be employed in a reflection-type semiconductor photocathode 1.

Because the amounts of raw materials supplied and growth temperatures used when growing a buffer layer and optical absorption layer by the MOCVD method depend on the MOCVD system reaction chamber shape and other parameters, they should be chosen appropriately, and are not limited to the values stated in the explanations of the above embodiments. For example, in the above first and second embodiments, the buffer layer 3 of AlN was grown at the comparatively low temperature of 450° C., but growth may be performed at a temperature of 1075° C. similar to that used when growing the optical absorption layer 4. When growing a buffer layer 3 at high temperature, there is a tendency for the surface flatness to be degraded, and so it is preferable that the film thickness be chosen with consideration paid to flatness. Specifically, a film thickness of the buffer layer 3 in the range from 10 nm to 1 mm is preferable, and a thickness between 15 nm and 500 nm is more preferable.

In place of TMGa, triethyl gallium (TEGa: $(C_2H_5)_3Ga$) or another metal-organic material may be used; in place of $NH_3$, tertial butylamine, ethyl azide, dimethyl hydrazine, or similar may be used.

In the above embodiments, sapphire was used as the substrate 2; but any one material selected from among the material group consisting of $LiGaO_3$, $NdGaO_3$, $LiAlO_3$, $MgAl_2O_4$, ZnO, MgO, AlN, GaN, and SiC may be used. However, when fabricating a transmission-type semiconductor photocathode 11, attention must be paid to the energy band gap of the material comprised by the substrate 2 to be used. That is, the substrate 2 must be transparent to the incident light hv, and so the band gap of the substrate 2 must be greater than that of the buffer layer 3 and optical absorption layer 4.

Further, depending on the material comprised by the substrate 2, the preprocessing and thermal cleaning temperatures and similar of the substrate 2 will be different, and so of course the preprocessing and thermal cleaning temperatures and other conditions must be set appropriately for each substrate to be used. In particular, when using a substrate 2 comprising $NdGaO_3$ or other oxide materials, in order to prevent reduction of the substrate surface, conditions must be changed such that, for example, the thermal cleaning is performed in an $N_2$ atmosphere.

In the above first and second embodiments, Mg was added to the buffer layer 3 to make the layer low-resistivity p-type material, and a portion of the optical absorption layer 4 and surface layer 5 were removed by etching to expose the buffer layer 3, and an electrode 6 was formed on this exposed portion. However, a buffer layer without Mg added may be used, a portion of the surface layer 5 removed by etching to expose the optical absorption layer 4, and the electrode 6 provided on this exposed portion.

A semiconductor photocathode of this invention can be applied in photomultiplier tubes, photoelectric tubes, and in image intensifiers and other imaging tubes and measurement equipment.

Figure 11:
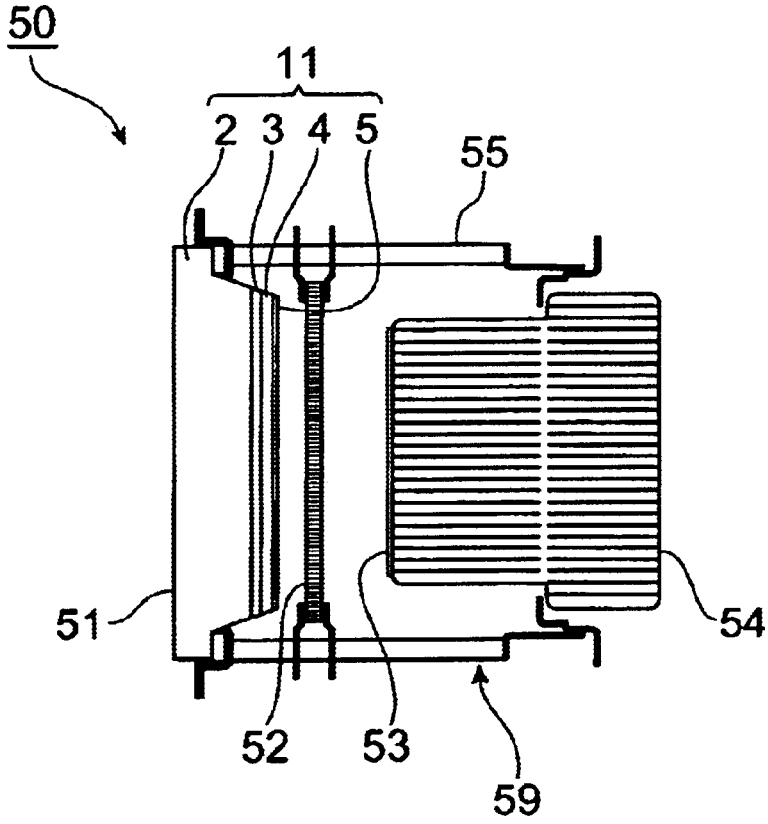

FIG. 11 is a schematic diagram of an image intensifier to which is applied a semiconductor photocathode 11 of the above second embodiment of this invention. As shown in FIG. 11, in the image intensifier 50, a vacuum container 59 is sealed and depressurized with a transmission-type semiconductor photocathode 11 of the second embodiment serving as the window portion. The semiconductor photocathode 11 is machined to be round or rectangular, and the peripheral portion thereof is ground from the side of the surface layer 5 so as to be thin.

At the thinner peripheral portion, (the semiconductor photocathode 11) is fixed using In or similar to the side tube 55. At this time, the rear face (the surface on which the buffer layer 3 and optical absorption layer 4 are not formed) of the substrate 2 of the semiconductor photocathode 11 is exposed to the outer side of the vacuum container, and this face serves as the light-incidence window 51 of the image intensifier 50. Within the container 59, a multichannel plate (MCP) 52 is provided so as to be opposed to the surface layer 5 of the semiconductor photocathode 11.

A fluorescent screen 53 is provided at a position on the opposite side of the MCP 52 from the semiconductor photocathode 11. A fiber optic plate or fiber optic component (FOP) 54 is provided so as to make contact with the fluorescent screen 53, and these, together with the semiconductor photocathode 11 and side tube 55, are comprised by the vacuum container 59.

When an optical image is projected onto the light-incidence window 51, electrons are emitted from the surface layer 5 of the semiconductor photocathode 11. The two-dimensional distribution (along the surface of the surface layer 5) of the number of electrons emitted from the surface layer 5 corresponds to the intensity distribution of the projected optical image. The emitted electrons travel toward the MCP 52, held at a higher potential than the semiconductor photocathode 11. Electrons which are incident on the MCP 52 are multiplied by the MCP 52, and these travel toward the fluorescent screen 53, which is held at a potential higher than that of the MCP 52.

When electrons traveling toward the fluorescent screen 53 collide with the fluorescent screen 53, the fluorescent screen 53 emits light, and an image is formed on the fluorescent screen 53. The two-dimensional distribution of the number of electrons colliding with the fluorescent screen 53 corresponds to the intensity distribution of the optical image which is to be measured, and so an image corresponding to the optical image for measurement is formed on the fluorescent screen 53. The image on the fluorescent screen 53 is observed via the FOP 54. In this way, the optical image for measurement is intensified by the image intensifier 50 and is observed.

Because the semiconductor photocathode 11 of the above second embodiment has a high quantum efficiency with respect to ultraviolet light, by using this image intensifier 50, optical images formed by ultraviolet light can be rendered visible, and can be observed with good sensitivity.

When the semiconductor photocathode 11 of the second embodiment is applied to an image intensifier 50, after forming the surface layer 5, it is appropriate to seal the semiconductor photocathode 11 within the vacuum chamber 59 shown in FIG. 11 within the depressurized vacuum chamber in which the surface layer 5 was formed, without exposing the semiconductor photocathode 11 to air. By this means, fabrication tasks can be performed more efficiently, and in addition contamination of the uppermost portion of the surface layer 5 can be prevented.

As explained above, in the semiconductor photocathodes 1 and 11 which are excited by incident light and emit photoelectrons, the optical absorption layer 4 which absorbs the incident light and generates photoelectrons is formed from an $Al_xGa_{1-x}N$ layer ($0 \leqq x \leqq 1$) in which the Mg concentration is greater than or equal to $2\times10^{19}$ $cm^{-3}$ and less than or equal to $1\times10^{20}$ $cm^{-3}$ so that quantum efficiency can be increased. Consequently a semiconductor photocathode of this configuration can be used for high-precision measurements.

Further, in an semiconductor photocathode of the above embodiments, the $Al_xGa_{1-x}N$ layer forming the optical absorption layer 4 has an (Al) content x of $0.3 \leqq x \leqq 0.4$, so that sensitivity is high in the wavelength range of 300 nm or less, and a so-called solar-blind type semiconductor photocathode is realized. Hence measurements can be performed without being affected by the short-wavelength components of sunlight. Also, the Al content x of the optical absorption layer 4 is 0.4 or less, so that by adding Mg to the optical absorption layer 4 low resistivity is obtained, and appropriate electrical properties as an optical absorption layer 4 are realized.

INDUSTRIAL APPLICABILITY

This invention can be applied to semiconductor photocathodes.

What is claimed:

1. A semiconductor photocathode, which is excited by incident light and emits photoelectrons, characterized in that an optical absorption layer which absorbs said incident light and emits said photoelectrons is formed from $Al_xGa_{1-x}N$ layer ($0 \leqq x \leqq 1$) in which the content concentration of Mg is not less than $2\times10^{19}$ $cm^{-3}$ and not more than $1\times10^{20}$ $cm^{-3}$.

2. The semiconductor photocathode according to claim 1, characterized in that the $Al_xGa_{1-x}N$ layer forming said optical absorption layer has a composition ratio x such that $0.3 \leqq x \leqq 0.4$.

3. The semiconductor photocathode of claim 1, wherein said absorption layer is configured to provide the semiconductor photocathode with high quantum efficiency.

4. The semiconductor photocathode of claim 1, wherein said absorportion layer is configured such that the semiconductor photocathode comprises a solar-blind semiconductor photocathode with high quantum efficicency.

* * * * *

UNITED STATES PATENT AND TRADEMARK OFFICE

CERTIFICATE OF CORRECTION

PATENT NO. : 6,831,341 B2 
DATED : December 14, 2004
INVENTOR(S) : Kan et al.

It is certified that error appears in the above-identified patent and that said Letters Patent is hereby corrected as shown below:

Column 14,
Line 66, replace "(0□x□1)" with -- (0.3□x□0.4) --.

Column 15,
Lines 1-4, delete "2. The semiconductor photocathode according to claim 1, characterized in that the $Al_xGa_{l-x}N$ layer forming said optical absorption layer has a composition ratio x such that 0.3□x□0.4.".
Line 5, replace "3." with -- 2. --.

Column 16,
Line 1, replace "4." with -- 3. --.

Signed and Sealed this

Sixth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,831,341 B2 
APPLICATION NO. : 10/416703
DATED : December 14, 2004
INVENTOR(S) : Kan et al.

It is certified that error appears in the above-identified patent and that said Letters Patent is hereby corrected as shown below:

Column 14,
Line 66, replace "$(0 \leqq x \leqq 1)$" with -- $(0.3 \leqq x \leqq 0.4)$ --.

Column 15,
Lines 1-4, delete "2. The semiconductor photocathode according to claim 1, characterized in that the $Al_xGa_{l-x}N$ layer forming said optical absorption layer has a composition ratio x such that $0.3 \leqq x \leqq 0.4$.".
Line 5, replace "3." with -- 2. --.

Column 16,
Line 1, replace "4." with -- 3. --.

This certificate supersedes the Certificate of Correction issued June 6, 2006.

Signed and Sealed this

Eighth Day of January, 2008

JON W. DUDAS
*Director of the United States Patent and Trademark Office*